US005322833A

United States Patent [19]

Defieuw et al.

[11] Patent Number: 5,322,833

[45] Date of Patent: Jun. 21, 1994

[54] DYE-DONOR ELEMENT FOR USE ACCORDING TO THERMAL DYE SUBLIMATION TRANSFER

[75] Inventors: Geert Defieuw, Kessel-Lo; Emiel Verdonck, Berlaar, both of Belgium

[73] Assignee: Agfa-Gevaert, N.V., Mortsel, Belgium

[21] Appl. No.: 989,361

[22] Filed: Dec. 11, 1992

[30] Foreign Application Priority Data

Jan. 28, 1992 [EP] European Pat. Off. ..... 92200229.0

[51] Int. Cl.[5] ..... B41M 5/035; B41M 5/38

[52] U.S. Cl. ..... 503/227; 428/195; 428/447; 428/488.4; 428/913; 428/914

[58] Field of Search ..... 8/471; 428/195, 447, 428/689, 913, 914, 488.4; 503/227

[56] References Cited

U.S. PATENT DOCUMENTS 4,764,496 8/1988 Narvi et al. ..... 503/227

*Primary Examiner*—B. Hamilton Hess

*Attorney, Agent, or Firm*—Breiner & Breiner

[57] ABSTRACT

Dye-donor element for use according to thermal dye sublimation transfer, said dye-donor element comprising a support having on one side a dye layer and on the other side a heat-resistant layer provided with a topcoat layer, wherein said heat-resistant layer comprises an organic polymeric binder and the topcoat layer is obtained by coating a solution of at least one silicone compound and a substance, capable of forming during the coating procedure a polymer having an inorganic backbone which is an oxide of a group IVa or IVb element.

11 Claims, No Drawings

DYE-DONOR ELEMENT FOR USE ACCORDING TO THERMAL DYE SUBLIMATION TRANSFER

1. FIELD OF THE INVENTION

The present invention relates to dye-donor elements for use according to thermal dye sublimation transfer and in particular to a heat-resistant layer and a topcoat layer of said dye-donor element,

2. BACKGROUND OF THE INVENTION

Thermal dye sublimation transfer also called thermal dye diffusion transfer is a recording method in which a dye-donor element provided with a dye layer containing sublimable dyes having heat transferability is brought into contact with a receiver sheet and selectively, in accordance with a pattern information signal, heated with a thermal printing head provided with a plurality of juxtaposed heat-generating resistors, whereby dye from the selectively heated regions of the dye-donor element is transferred to the receiver sheet and forms a pattern thereon, the shape and density of which is in accordance with the pattern and intensity of heat applied to the dye-donor element.

A dye-donor element for use according to thermal dye sublimation transfer usually comprises a very thin support e.g. a polyester support, one side of which is covered with a dye layer, which contains the printing dyes. Usually an adhesive or subbing layer is provided between the support and the dye layer.

Due to the fact that the thin support softens when heated during the printing operation and then sticks to the thermal printing head thereby causing malfunctioning of the printing apparatus and reduction in image quality the backside of the support (side opposite to the dye layer) is typically provided with a heat-resistant layer to facilitate passage of the dye-donor element under the thermal printing head. An adhesive layer may be provided between the support and the heat-resistant layer.

The heat-resistant layer generally comprises a lubricating material and a binder. In the conventional heat-resistant layers the binder is either a cured binder (as described in, for example, EP 153880, EP 194106, EP 314348, EP 329117, JP 60/151096, JP 60/229787, JP 60/229792, JP 60/229795, JP 62/48589, JP 62/212192, JP 62/259889, JP 01/5884, JP 01/56587, JP 02/128899) or a polymeric thermoplast (as described in, for example, EP 267469, JP 58/187396, JP 63/191678, JP 63/191679, JP 01/234292, JP 02/70485).

These thermostable binders are usually mixed with lubricants such as silicones, fluorine-containing compounds and the like. When these lubricating agents are incorporated in the heat-resistant layer, only a small portion of the lubricating material is in direct contact with the thermal head leading to ineffective slipping relative to the thermal head during printing and occurrence of color drift. This problem can be solved by applying the lubricating material as a separate topcoat on top of the heat-resistant polymeric layer. Such an assembly of a heat-resistant layer and a separate lubricating topcoat on top of the heat-resistant layer is described in U.S. Pat. No. 4,666,320.

Silicone-based lubricants, such as liquid silicone oils, and liquid silicone blockcopolymers (e.g. blockcopolymers of polysiloxane and polyether) can be used as separate topcoats on top of the heat-resistant layer. This improves the slipping properties of the donor element. However, dyes in the dye donor element tend to crystallize during storage of the dye-donor element in rolled form, due to the contact between the silicone compound contained in the topcoat of one wrapping and the dye donor layer of the underlying wrapping. This problem can be solved by using solid silicones or crosslinked silicones in the topcoat layer. However, the slipping properties of a donor element with such a topcoat are insufficient and color drift occurs during printing.

Inorganic polymers have been described as slipping layers in contact with the thermal head (see U.S. Pat. No. 4,764,496), however, without the addition of slipping agents such as silicones. These slipping layers tend to stick to the thermal head, causing malfunctioning of the printing apparatus.

3. SUMMARY OF THE INVENTION

It is an object of the present invention to provide topcoat layers on top of heat-resistant layers of dye-donor elements not having the disadvantages mentioned above.

According to the present invention, a dye-donor element for use according to thermal dye sublimation transfer is provided, said dye-donor element comprising a support having on one side a dye layer and on the other side a heat-resistant layer provided with a topcoat layer, characterized in that said heat-resistant layer comprises an organic polymeric binder and the topcoat layer is obtained by coating a solution of at least one silicone compound and a substance, capable of forming during the coating procedure a polymer having an inorganic backbone which is an oxide of a group IVa or IVb element.

Dye-donor elements according to the present invention show excellent slipping properties towards the thermal head, are easy to manufacture and induce no crystallisation of the dyes during storage of the donor element in rolled or folded form.

4. DETAILED DESCRIPTION OF THE INVENTION

The topcoat layer of the present invention comprises at least one silicone compound. This silicone compound is preferably liquid. Examples of suitable silicone compounds are silicone oils, silicone blockcopolymers (e.g. blockcopolymers of polyether or polyester and polysiloxane), isocyanate or hydroxy- or amino- or acid-modified silicones. Especially preferred are polyether-polysiloxane blockcopolymers.

Additionally to the silicone compound, other lubricants known in the art can be used. Examples are fluorine-containing compounds such as teflon, fatty acid esters or amides, alkylphosphates and the like. Solid particles can also be added to this topcoat layer.

The polymer having an inorganic backbone which is an oxide of a group IVa or IVb element for use according to the present invention is formed during the coating procedure. This in situ polymerization yields uniform films, the silicone compound being homogeneously dispersed or dissolved in the thin topcoat layer. Mixing of e.g. colloidal silica with the lubricating agents would provide donor elements with inadequate storage stability.

Useful polymers having inorganic backbones for use according to the present invention are polymers obtained by the polymerization of organic titanates, zirconates or silanes.

Organic titanates can be selected from the tetraalkyltitanates and titanate chelates, e.g. those supplied by Dupont, Wilmington, USA, under the name TYZOR or by Hüls Aktiëngesellschaft, Germany. The tetraalkyltitanates with high reactivity are especially preferred, e.g. tetraisopropyltitanate and tetra-n-butyltitanate.

Organic zirconates, such as tetraisopropyl zirconate and silanes such as those supplied by DOW Corning, Brussels, Belgium, under the names Z-6020 and Z-6040 can also be used to form the polymer having an inorganic backbone.

Catalysts known in the state of the art, such as acids, can be added to increase the rate of hydrolysis. Mixtures of titanates, zirconates and silanes can also be used.

The amount of polymer relative to the amount of silicone in the topcoat of the present invention is typically 10 to 200% by weight, preferably 20 to 100% by weight.

The coating solvent can be any solvent known in the art. Alcohols, such as isopropanol and 1-butanol are especially preferred, since no or little hydrolysis takes place during the preparation of the coating liquid. Hydrolysis of the titanates, zirconates and silanes in the coating liquids yields non-uniform topcoat layers after the coating and drying procedure.

Others polymers or additives can be added to the topcoat layer, as long as the printing process is not detrimentally affected. Examples are polymers soluble in the coating liquid, dispersed particles such as silica, teflon, ester- and amide-waxes, zinc stearate and the like.

The thickness of the topcoat layer is not very critical. Typically the thickness ranges from 0.01 μm to 2 μ, preferably from 0.02 μm to 0.5 μm.

The heat-resistant layer of the dye-donor element according to the present invention contains one or more of the conventional thermoplastic binders known for slipping layers in dye-donor elements such as poly(styrene-co-acrylonitrile), poly(vinylalcohol -co-butyral), poly(vinylalcohol -co-acetal), poly(vinylalcohol -co-benzal), polystyrene, cellulose nitrate, cellulose acetate propionate, cellulose acetate hydrogen phthalate, cellulose acetate, cellulose acetate butyrate, cellulose triacetate, ethyl cellulose, poly(methylmethacrylate), copolymers of methylmethacrylate and polycarbonates. Polycarbonates soluble in ketones such as those described in European patent application no. 91202071.6 and the corresponding U.S. Ser. No. 921,087 are especially preferred.

The above-mentioned binders may be cured by radiation energy or by any crosslinking agent known in the art. Examples of crosslinking agents are aziridines and polyisocyanates.

The heat-resistant layer can further contain solid particles such as colloidal silica, silica particles of a size larger than 100 rim, teflon beads (e.g. Hostaflon TF VP9202 supplied by Hoechst, Germany), talc particles (e.g. Nippon Talc P-3 supplied by Interorgana Chemiehandel GMBH, Köln, Germany), polyethylene particles, wax particles and the like. These particles can protrude out of the surface of the donor element in order to further enhance the storage properties of the ribbon in rolled or folded form. These particles can be incorporated in one of the layers of the backside of the donor element or in the dye layer. Silica, teflon and talc are especially preferred. This method to enhance the storage stability by incorporation of particles in one of the layers of the backside of the donor element is also effective in conventional dye-donor elements, i.e. dye-donor elements not having a separate topcoat on top of the heat-resistant layer or having topcoats based on silicone oils or silicone blockcopolymers (e.g. polyether-polysiloxane) in the absence of a polymer having an inorganic backbone.

The heat-resistant layer of the thermal dye sublimation transfer donor element according to the present invention is formed preferably by adding the polymeric thermoplastic binder or binder mixture, and other optional components to a suitable solvent or sol vent mixture, dissolving or dispersing the ingredients to form a coating composition that is applied to a support, which may have been provided first with an adhesive or subbing layer, and dried.

The heat-resistant layer of the dye-donor element may be coated on the support or printed thereon by a printing technique such as a gravure process.

The heat-resistant layer thus formed has a thickness of about 0.1 to 3 pm, preferably 0.3 to 1.5 μm.

Preferably a subbing layer is provided between the support and the heat-resistant layer to promote the adhesion between the support and the heat-resistant layer. As subbing layer any of the subbing layers known in the art for dye-donor elements can be used. Suitable binders that can be used for the subbing layer can be chosen from the classes of polyester resins, polyurethane resins, polyester urethane resins, modified dextrans, modified cellulose, and copolymers comprising recurring units such as i.e. vinylchloride, vinylidenechloride, vinylacetate, acrylonitrile, methacrylate, acrylate, butadiene, and styrene (e.g. poly(vinylidenechloride-co-acrylonitrile). Suitable subbing layers are described in e.g. EP 138483, EP 227090, U.S. Pat. Nos. 4567113, 4,572,860, 4,717,711, 4,559,273, 4,695,288, 4,727,057, 4,737,486, 4,965,239, 4,753,921, 4,895,830, 4,929,592, 4,748,150, 4,965,238 and 5,965,241. Preferably the subbing layer further comprises an aromatic polyol such as 1,2-dihydroxybenzene as described in EP 433496 or a polymer having an inorganic backbone. Preferred subbing layers especially for polycarbonate containing heat-resistant layers are described in European patent application no. 91202071.6 and in the corresponding U.S. Ser. No. 921,087. Other preferred subbing layers (especially for polycarbonate containing heat-resistant layers) are based on mixtures of phloroglucinol with a polyesterurethane, a titanate chelate (such as Tyzor AA supplied by Dupont, USA) or tetraalkyltitanates or mixtures of resorcinol, hydroquinone or pyrogallol with polycarbonates derived from 1,1-bis-(4-hydroxyphenyl)-3,3,5-trimethylcyclohexane. The above described subbing layers are also effective in assemblies of heat-resistant layers and topcoat layers wherein the topcoat layer contains a silicone oil (e.g. Tegoglide 410 supplied by Goldschmidt, Brussels, Belgium) in the absence of a polymer having an inorganic backbone and in dye-donor elements not having separate topcoat layers on top of the heat-resistant layer.

Any dye can be used in the dye layer of the dye-donor element of the present invention provided it is transferable to the dye-receiving layer by the action of heat. Examples of suitable dyes are described in, for example, EP 432829, EP 400706, EP 453020, European Patent application No. 90203014.7 and the corresponding U.S. Ser. No. 789,674 and European Patent Application No. 91200218.5 and in the corresponding U.S. Ser. No. 821,564, and the references mentiones therein.

The amount ratio of dye or dye mixture to binder i s between 9:1 and 1:3 by weight, preferably between 3:1 and 1:2 by weight.

As polymeric binder for the dye layer the following can be used: cellulose derivatives, such as ethyl cellulose, hydroxyethyl cellulose, ethylhydroxy cellulose, ethyl hydroxyethyl cellulose, hydroxypropyl cellulose, methyl cellulose, nitrocellulose, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, poly(vinylbutyral-co-vinylacetal-co-vinylalcohol), polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; poly(styrene-co-acrylonitrile); polysulfones; polyphenylene oxide; organosilicones, such as polysiloxanes; epoxy resins and natural resins, such as gum arabic. Preferably cellulose acetate butyrate or poly(styrene-co-acrylonitrile) is used as binder for the dye layer of the present invention.

The dye layer may also contain other additives, such as thermal solvents, stabilizers, curing agents, preservatives, organic or inorganic fine particles such as, teflon beads, silica, waxes and the like, dispersing agents, antistatic agents, defoaming agents, viscosity controlling agents, etc., these and other ingredients being described more fully in EP 133011, EP 133012, EP 111004 and EP 279467.

Another method of further decreasing the sticking between the backing layer and the dye layer during storage of the donor element in rolled form is the incorporation of polyolefin particles such as Hordamer PE03 (polyethylene latex) supplied by Hoechst, Germany, Perapret PE40 (polyethylene latex) supplied by BASF, Ludwigshaven, Germany, Lancowax PE1544 (polyethylene particles of I to 10 μm and melting point 130° C.) and Lancowax PE1500 (polyethylene particles of 4 μm and melting point 110° C.) both supplied by Langer, Crayvalley, Belgium, Aqua Poly AP250 (polyethylene particles smaller than 13 μm and melting point between 117 and 123° C.) supplied by Floridienne, Brussels, Belgium, Micronised synthetic waxes MP22C (polyethylene particles smaller than 10 μm and melting point between 101° and 106° C.) and 620XF (polyethylene particles smaller than 8 μm and melting point 110° C.) both supplied by Floridienne, Brussels, Belgium, Microthene FN500 (polyethylene particles of about 20 μm and melting point between 96° and 112° C.) and FN510 (polyethylene particles of about 30 μm and melting point 97° C.) both supplied by USI, Antwerp, Belgium, Ceracol 39 (polyethylene particles of 5 to 8 μm) supplied by Cera Chemie, Deventer, Holland, Polymist A12 (polyethylene particles of 5 to 40 μm and melting point 138° C.) supplied by Allied Colloids, Nijvel, Belgium, and Ceridust 3620, 130, 9610 F, 9615A, 9630F all supplied by Hoechst, Germany, in one of the layers at the dye side of the dye-donor element. Amide waxes such as Ceridust 3910 supplied by Hoechst, Germany, can also be incorporated in one of the layers at the dye side of the donor element. Application of such amide waxes is especially preferred. Addition of one or more of the above mentioned types of particles to the dye layer is especially preferred, in particular if the dye layer contains poly(styrene-co-acrylonitrile).

This method to enhance the storage stability is also effective in conventional dye-donor elements i.e. dye-donor elements not having separate topcoats on top of the heat-resistant layer or having topcoats based on silicone oils in the absence of a polymer having an inorganic backbone.

Any material can be used as the support for the dye-donor element provided it is dimensionally stable and capable of withstanding the temperatures involved, up to about 400° C over a period of up to 20 msec and yet thin enough to transmit heat applied on one side through to the dye on the other side to effect transfer to the receiver sheet within such short periods, typically from I to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. In general, the support has a thickness of 2 to 30 μm. The support may also be coated with an adhesive or subbing layer, if desired. Examples of suitable subbing layers are described, for example, in EP 433496, EP 311841, EP 268179, U.S. Pat. Nos. 4,727,057, 4,695,288.

A dye-barrier layer comprising a hydrophilic polymer may also be employed in the dye-donor element between its support and the dye layer to improve the dye transfer densities by preventing wrong-way transfer of dye towards the support. The dye barrier layer may contain any hydrophilic material which is useful for the intended purpose. In general, good results have been obtained with gelatin, polyacrylamide, polyisopropyl acrylamide, butyl methacrylate grafted gelatin, ethyl methacrylate grafted gelatin, ethyl acrylate grafted gelatin, cellulose monoacetate, methyl cellulose, polyvinyl alcohol, polyethylene imine, polyacrylic acid, a mixture of polyvinyl alcohol and polyvinyl acetate, a mixture of polyvinyl alcohol and polyacrylic acid or admixture of cellulose monoacetate and polyacrylic acid. Suitable dye barrier layers have been described in e.g. EP 227091 and EP 228065. Certain hydrophilic polymers, for example those described in EP 227091, also have an adequate adhesion to the support and the dye layer, thus eliminating the need for a separate adhesive or subbing layer. These particular hydrophilic polymers used in a single layer in the donor element thus perform a dual function, hence are referred to as dye-barrier/subbing layers.

The support for the receiver sheet that is used with the dye-donor element may be a transparent film of e.g. polyethylene terephthalate, a polyether sulfone, a polyimide, a cellulose ester or a polyvinyl alcohol-co-acetal. The support may also be a reflective one such as baryta-coated paper, polyethylene-coated paper or white polyester i.e. white-pigmented polyester. Blue-colored polyethylene terephthalate film can also be used as support.

To avoid poor adsorption of the transferred dye to the support of the receiver sheet this support must be coated with a special surface, a dye-image-receiving layer, into which the dye can diffuse more readily. The dye-image-receiving layer may comprise, for example, a polycarbonate, a polyurethane, a polyester, a polyamide, polyvinyl chloride, poly(styreneco-acrylonitrile), polycaprolactone or mixtures thereof. Suitable dye-receiving layers have been described in e.g. EP 133011, EP 133012, EP 144247, EP 227094, EP 228066. The dye-image-receiving layer may also comprise a cured binder such as the heat-cured product of poly(vinylchloride-co-vinylacetate-co-vinylalcohol) and polyisocyanate.

In order to improve the light resistance and other stabilities of recorded images, UV absorbers, singlet oxygen quenchers such as HALS-compounds (Hindered Amine Light Stabilizers) and/or antioxidants may be incorporated into the receiving layer.

The dye layer of the dye-donor element or the dye-image-receiving layer of the receiver sheet may also contain a releasing agent that aids in separating the dye-donor element from the dye-receiving element after transfer. The releasing agents can also be applied in a separate layer on at least part of the dye layer or of the receiving layer. For the releasing agent solid waxes, fluorine- of phosphate-containing surfactants and silicone oils are used. Suitable releasing agents are described in e.g. EP 133012, JP 85/19138, EP 227092.

The thermal dye sublimation transfer printing process comprises placing the dye layer of the donor element in face-to-face relation with the dye-receiving layer of the receiver sheet and imagewise heating from the back of the donor element. The transfer of the dye is accomplished by heating for about several milliseconds at a temperature of about 400° C.

When the process is performed for but one single color, a monochrome dye transfer image is obtained. A multicolor image can be obtained by using a donor element containing three or more primary color dyes and sequentially performing the process steps described above for each color. The above sandwich of donor element and receiver sheet is formed on three occasions during the time when heat is applied by the thermal printing head. After the first dye has been transferred, the elements are peeled apart. A second dye-donor element (or another area of the donor element with a different dye area) is then brought in register with the dye-receiving element and the process repeated. The third color and optionally further colors are obtained in the same manner.

In addition to thermal heads, laser light, infrared flash or heated pens can be used as the heat source for supplying heat energy. Thermal printing heads that can be used to transfer dye from the dye-donor elements of the present invention to a receiver sheet are commercially available. In case laser light is used, the dye layer or another of the dye donor-element layers has to contain a compound that absorbs the light emitted by the laser and converts it into heat, e.g. carbon black.

Alternatively, the support of the dye-donor element may be an electrically resistive ribbon consisting of, for example, a multi-layer structure of a carbon-loaded polycarbonate coated with a thin aluminum film. Current is injected into the resistive ribbon by electrically addressing a print head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology compared to the thermal head technology where the various elements of the thermal head get hot and must cool down before the head can move to the next printing position.

The following examples are provided to illustrate the invention in more detail without limiting, however, the scope thereof.

EXAMPLES

A dye-donor element for use according to thermal dye sublimation transfer was prepared as follows :

A solution comprising 2.4 wt % of dye A, 8 wt % of dye B, 6.4 wt % of dye C and 8 wt % of poly(styrene-co-acrylonitrile) as binder in methyl ethyl ketone as solvent was prepared.

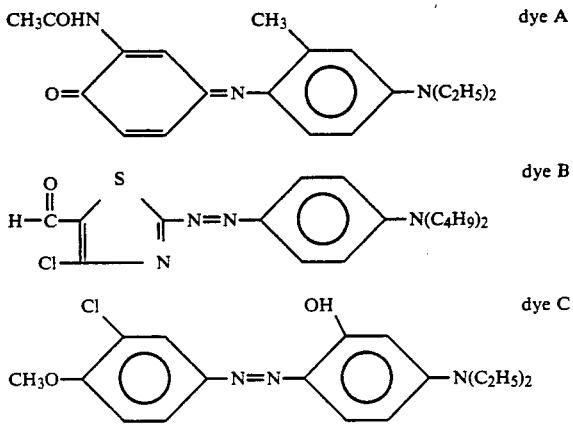

From this solution, a layer having a wet thickness of 10 μm was coated on 6 μm thick polyethylene terephtalate film, provided with a conventional subbing layer. The resulting layer was dried by evaporation of the solvent.

The back side of the polyethylene terephtalate film was provided with a subbing layer, coated from a solution in methyl ethyl ketone (MEK) or isopropanol (ISO) comprising the ingredients as indicated in Tables I and II below.

On top of said subbing layer, a heat-resistant layer was provided, coated from a solution in MEK containing the ingredients as indicated in Tables I and II below.

On top of said heat-resistant layer, a topcoat layer was provided coated from a solution in isopropanol containing the ingredients as indicated in Tables I and II below.

The amounts indicated in Tables I and II are weight percentages in the coating solution. All coating liquids were applied at a wet thickness of 10 μm.

A receiving layer containing 7.2 g/m$^2$ poly(vinylchloride-covinylacetate-co-vinylalcohol) (VINYLITE VAGD supplied by Union Carbide), 0.72 g/m$^2$ diisocyanate (DESMODUR VL supplied by Bayer AG) and 0.2 g/m$^2$hydroxy-modified polydimethylsiloxane (TEGOMER H SI 2111 supplied by Goldschmidt) was provided on a 175 μm thick polyethylene terephthalate film.

The dye-donor element was printed in combination with the receiving element in a Mitsubishi color video printer type CPlOOE.

The receiver sheet was separated from the dye-donor element and the image quality of the obtained image was evaluated by visually checking color drift occurring when overlayed printing is repeated several times leading to decreased sharpness of the transferred image and scratches on the image. Further the damage to the heat-resistant layer after printing was checked by visual inspection on scratches and dullness (is a measure for the heat stability of the heat-resistant layer).

A defect in the performance of the topcoat layer causes intermittent rather than continuous transport across the thermal head leading to color drift. Further sticking of the backing layer to the thermal head leads to damaging of the heat-resistant layer. When abrated or melted parts from the backcoat build up on the thermal head, scratches are induced in the donor element and also in the obtained image on the receiving element.

The backside of the non-printed donor element (the side containing the heat-resistant layer and top layer) was subjected to a tape adhesion test. A small piece of transparant tape was firmly pressed by hand over an area of the donor element. Upon manually pulling the tape, removal of the backing layer together with the tape is checked as a measure of the adhesion between the support and the heat-resistant layer. Ideally none of the backing layer would be removed.

The stability of the non-printed donor element in rolled or folded form was checked by storing the donor element in rolled form for 24 hours at 45° C. and by checking whether dye has crystallized in the dye layer or sticking occurs between the dye layer of one wrapping and the back layer of the next wrapping.

For all the above visual evaluations the following categories were established: poor (P), fair (F), good (G) and excellent (E).

This experiment was repeated for each of the dye-donor elements identified in tables I and II below. The results are given in Table I examples according to the present invention) and Table II (comparative examples) below.

It can be seen from table I that the crystallization of the dye mixture during storage in rolled form is substantially decreased by using a mixture of a silicone oil and a titanate, zirconate of silane compound in the coating liquid for the topcoat. Especially combinations of polysiloxane-polyether blockcopolymers with reactive organic titanates yield donor ribbons with enhanced storage stability (examples 1–5).

The organic titanate forms a polymer with an inorganic backbone during the drying procedure.

In Tables I and II:

S1 represents a silicone blockcopolymer supplied under the name Tegoglide 410 by Goldsmidt, Brussels, Belgium S2 represents an hydroxy modified silicone oil supplied under the name Tegomer H SI 2111 by Goldsmidt, Brussels, Belgium P1 represents titanacetylacetonate supplied under the name Tyzor AA by Dupont, Wi 1 mi rigton, USA P2 represents a copolycarbonate derived from 45 mol % bisphenol A and 55 mol % of 1,1-bis-(4-hydroxyphenyl)-3,3,5-trimethylcyclohexane P3 represents nitrocellulose supplied by Wolff Walsrode, Walsrode, Germany P4 represents tetraisopropyltitanate supplied under the name Tyzor TPT by Dupont, Wi 1 mi rigton, USA P5 represents

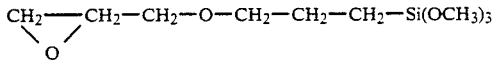

P6 represents tetrai sopropyl zirconate

P7 represents tetrabutyltitanate supplied under the name Tyzor TBT by Dupont, Wilmington, USA P8 represents poly(styrene-co-acrylonitrile) supplied under the name Luran 388S by BASF, Ludwigshaven, Germany P9 represents cellulose acetate propionate supplied under the name PLFS130 by Celanese, Kentucky, USA P10 represents a polyesterurethane supplied under the name Desmocoll 540 by Bayer, Leverkusen, Germany P11 represents poly(vinylchloride-co-vinylacetate-co-vinylalcohol) supplied under the name Vinylite VAGD by Union Carbide, Antwerp, Belgium P12 represents a vinylidene copolymer supplied under the name Saran F310 by Dow Chemical, Terneuzen, Holland P13 represents 1,2-dihydroxybenzene P14 represents colloidal silica supplied under the name Aerosil R972 by Degussa, Frankfurt, Germany

TABLE I

| | | | | Printing | | Donor Stability | | |
|---|---|---|---|---|---|---|---|---|
| Nr. | Subbing layer | Heat-resistant layer | Topcoat layer | Color Drift | Damage | Tape-test | Crystall | Sticking |
| 1 | 0.25% P1, ISO | 13% P2 | 0.5% S1, 0.5% P4 | E | E | F | E | G |
| 2 | 1.5% P10, 1.5% P13, MEK | 13% P2 | 0.5% S1, 0.5% P4 | G | G | F | E | G |
| 3 | 1.5% P10, 1.5% P13, 3% P8, MEK | 13% P2 | 0.5% S1, 0.5% P4 | G | G | E | E | G |
| 4 | 1.5% P10, 1.5% P13, 4% P11, MEK | 13% P2 | 0.5% S1, 0.5% P4 | G | G | G | E | G |
| 5 | 0.5% P12, 0.5% P14, MEK | 13% P2 | 0.5% S1, 0.5% P4 | F | G | G | E | G |
| 6 | 0.25% P1, ISO | 13% P2 | 0.5% S1, 0.5% P1 | G | G | F | G | G |
| 7 | 0.25% P1, ISO | 13% P2 | 0.5% S1, 0.5% P5 | G | G | F | G | G |
| 8 | 0.25% P1, ISO | 13% P2 | 0.5% S1, 0.5% P6 | G | G | F | G | G |
| 9 | 0.25% P1, ISO | 13% P2 | 0.5% S1, 0.5% P7 | G | G | F | G | G |
| 10 | 0.25% P1, ISO | 13% P2 | 0.5% S2, 0.5% P4 | G | G | F | G | G |
| 11 | 0.25% P1, ISO | 13% P8 | 0.5% S1, 0.5% P4 | G | F | F | G | F |
| 12 | 0.25% P1, ISO | 13% P9 | 0.5% S1, 0.5% P4 | E | G | G | G | F |

TABLE II

| | | | | Printing | | Donor Stability | | |
|---|---|---|---|---|---|---|---|---|
| Nr. | Subbing layer | Heat-resistant layer | Topcoat layer | Color Drift | Damage | Tape-test | Crystall | Sticking |
| 1 (comp) | 0.25% P1, ISO | 13% P2 | 0.25% S1 | F | G | F | F | F |
| 2 (comp) | 0.25% P1, ISO | 13% P2 | 0.5% S1 | G | G | F | P | F |
| 3 (comp) | 0.25% P1, ISO | 13% P2 | 0.5% S1, 0.5% P14 | F | G | F | P | F |

TABLE II-continued

| Nr. | Subbing layer | Heat-resistant layer | Topcoat layer | Printing Color Drift | Printing Damage | Donor Stability Tape-test | Donor Stability Crystall | Donor Stability Sticking |
|---|---|---|---|---|---|---|---|---|
| 4 (comp) | 0.25% P1, ISO | 13% P2 | 0.5% S1, 0.5% P3 | F | G | F | P | F |
| 5 (comp) | 0.25% P1, ISO | 13% P2 | 0.5% S2 | P | G | F | G | G |

We claim:

1. Dye-donor element for use according to thermal dye sublimation transfer, said dye-donor element comprising a support having on one side a dye layer and on the other side a heat-resistant layer provided with a top-coat layer, wherein said heat-resistant layer comprises an organic polymeric binder and the topcoat layer is obtained by coating a solution of at least one silicone compound and a substance capable of forming during the coating procedure a polymer having an inorganic backbone, which is an oxide of a group IVa or IVb element, said substance capable of forming an inorganic polymer being an organic titanate, zirconate, or silane.

2. Dye-donor element according to claim 1, wherein the substance capable of forming an inorganic polymer is tetraisopropyltitanate or tetrabutyl titanate.

3. Dye-donor element according to claim 1, wherein the silicone compound is a silicone oil or a polysiloxane-polyether blockcopolymer.

4. Dye-donor element according to claim 1, wherein the topcoat is coated from a solution in an alcohol.

5. Dye-donor element according to claim 1, wherein the amount of said polymer having an inorganic backbone in respect of the amount of silicone compound in the topcoat is 10 to 200 % by weight,

6. Dye-donor element according to claim 1, wherein said heat-resistant layer comprises a non-crosslinked cellulosic binder or a polycarbonate.

7. Dye-donor element according to claim 6, wherein said polycarbonate is a copolycarbonate derived from bisphenol A and at least 10 mole % of 1,1-bis-(4-hydroxyphenyl)-3,3,5-trimethylcyclohexane.

8. Dye-donor element according to claim 1, wherein one of the layers at the backside of said donor element further comprises solid particles.

9. Dye-donor element according to claim 8, wherein said particles are poly(tetrafluoroethylene), talc or silica particles.

10. Dye-donor element according to claim 1, wherein the dye layer further contains particles protruding out of the surface.

11. Dye-donorelement according to claim 10, wherein said particles are polyethylene or polypropylene beads or amide waxes.

* * * * *